US009838796B2

(12) United States Patent
Wu et al.

(10) Patent No.: US 9,838,796 B2
(45) Date of Patent: Dec. 5, 2017

(54) ELECTROACOUSTIC TRANSDUCER

(71) Applicant: GOERTEK INC., WeiFang, Shandong (CN)

(72) Inventors: Di Wu, Shandong (CN); Guanglei Liu, Shandong (CN)

(73) Assignee: GOERTEK INC., Shandong (CN)

( * ) Notice: Subject to any disclaimer, the term of this patent is extended or adjusted under 35 U.S.C. 154(b) by 0 days.

(21) Appl. No.: 15/038,808

(22) PCT Filed: Aug. 25, 2014

(86) PCT No.: PCT/CN2014/085091
§ 371 (c)(1),
(2) Date: May 24, 2016

(87) PCT Pub. No.: WO2015/078206
PCT Pub. Date: Jun. 4, 2015

(65) Prior Publication Data

US 2017/0006384 A1 Jan. 5, 2017

(30) Foreign Application Priority Data

Nov. 28, 2013 (CN) ..... 2013 1 0628754

(51) Int. Cl.
*H04R 9/06* (2006.01)
*H04R 9/02* (2006.01)
*H04R 9/04* (2006.01)

(52) U.S. Cl.
CPC ..... *H04R 9/025* (2013.01); *H04R 9/045* (2013.01); *H04R 9/06* (2013.01);
(Continued)

(58) Field of Classification Search
CPC ..... H04R 9/025; H04R 9/045; H04R 9/06; H04R 2209/027; H04R 2499/11
(Continued)

(56) References Cited

U.S. PATENT DOCUMENTS 8,516,681 B2 * 8/2013 Kuze ..... H04R 9/045 381/396
8,615,102 B2 * 12/2013 Marugami ..... H04R 9/025 381/421
2012/0308070 A1 * 12/2012 Lee ..... H04R 9/025 381/412

FOREIGN PATENT DOCUMENTS

CN 202907164 U 4/2013
CN 103095090 A 5/2013
(Continued)

OTHER PUBLICATIONS

Second Office Action from SIPO for corresponding Chinese application No. 201310628754.7, dated Nov. 15, 2016.
(Continued)

*Primary Examiner* — Brian Ensey
(74) *Attorney, Agent, or Firm* — Holzer Patel Drennan

(57) ABSTRACT

Disclosed is an electroacoustic transducer, comprising a vibration system and a magnetic circuit system, wherein the vibration system comprises a vibrating diaphragm and a voice coil; and the magnetic circuit system comprises a yoke, a central magnet, and edge magnets; wherein, each edge magnet has a strip shape, limiting parts are provided at two corners of any edge magnet closer to a magnetic gap, and the yoke is provided with stoppers abutted against the limiting parts at positions corresponding to the limiting parts. Each edge magnet of the present invention is provided with limiting parts formed by removing material, and the yoke is provided thereon with stoppers for preventing the edge magnets from approaching the central magnet, so that a bad phenomenon due to the fact that the edge magnets and the central magnet are attracted to each other can be avoided, thereby increasing the yield of a product.

4 Claims, 5 Drawing Sheets

(52) U.S. Cl.
CPC .... *H04R 2209/027* (2013.01); *H04R 2400/03* (2013.01); *H04R 2499/11* (2013.01)

(58) Field of Classification Search
USPC ..... 381/150, 396, 412, 421, 423
See application file for complete search history.

(56) References Cited

FOREIGN PATENT DOCUMENTS

| | | | |
|---|---|---|---|
| CN | 203136152 | U | 8/2013 |
| CN | 20322588 1 | U | 10/2013 |
| CN | 103686557 | A | 3/2014 |
| CN | 203590447 | U | 5/2014 |

OTHER PUBLICATIONS

First Office Action from SIPO for corresponding Chinese application No. 201310628754.7, dated Mar. 24, 2016.
First Office Action from KIPO for corresponding Korean application No. 10-2016-7016943, dated Mar. 9, 2017.

* cited by examiner

ELECTROACOUSTIC TRANSDUCER

CROSS-REFERENCE TO RELATED APPLICATIONS

The present application claims benefit of priority to PCT Application No. PCT/CN2014/085091, entitled "ELECTROACOUSTIC TRANSDUCER" and filed on 25 Aug. 2014, which is specifically incorporated by reference herein for all that it discloses or teaches. The present application claims further benefit of priority to Chinese Application No. 201310628754.7, which was filed 28 Nov. 2013 and is also specifically incorporated by reference herein for all that it discloses or teaches.

TECHNICAL FIELD

The present invention relates to the technical field of electro-acoustic products, specifically, to an electroacoustic transducer.

BACKGROUND

Currently, as portable electronics are widely used, electroacoustic transducers, serving as important acoustic devices, are widely used as well, and the electroacoustic transducers are required to be adjusted correspondingly due to relatively higher requirements on output power and sensitivity of electroacoustic components for electronics at present. In prior art, in order to increase the output power of the electroacoustic transducers, a dual magnetic circuit structure is generally used, wherein the dual magnetic circuit structure comprises a central magnet located at the central position of a yoke and edge magnets located at the edge positions of the yoke, and the central magnet, the edge magnets and the yoke are typically fixedly combined by bonding. The magnetic circuit system forms a closed magnetic field, so that the voice coil is subjected to force in the magnetic gap formed by the magnetic circuit system and vibrates up and down, and further vibrates a vibrating diaphragm to generate sound.

As for the above electroacoustic transducer with a dual magnetic circuit structure, the central magnet and the edge magnets attract each other, and the central magnet and the edge magnets are fixed only by being fixedly combined with the yoke. However, in the magnetic circuit system with such a structure, the firmness of bonding between the central magnet, the edge magnets and the yoke tends to be insufficient, which tends to cause the edge magnets and the central magnet to attach together due to the edge magnets approaching the central magnet, thereby causing defects in the products. Thus, there is a demand for improving the electroacoustic transducer with such a structure to eliminate the above defects.

SUMMARY

The technical problem sought to be solved by the present invention is to provide an electroacoustic transducer, which is capable of preventing the edge magnets from moving to the central magnet, so that defects occurred in the products due to the fact that the edge magnets and the central magnet are attracted to each other can be avoided.

In order to solve the above technical problem, the technical scheme of the present invention is that: an electroacoustic transducer, comprising a vibration system and a magnetic circuit system, wherein the vibration system comprises a vibrating diaphragm and a voice coil combined with the vibrating diaphragm on a lower surface thereof; and the magnetic circuit system comprises a yoke, a central magnet located at central position of the yoke and at a side of the yoke closer to the voice coil, and edge magnets located at edge positions of the yoke, wherein the magnetic circuit system is formed with a magnetic gap to accommodate the voice coil; wherein each of the edge magnets has a strip shape, limiting parts are provided on each of the edge magnets at two corners thereof closer to the magnetic gap, the limiting parts are formed by removing materials at the corners of the edge magnets, and the yoke is provided with stoppers, which are abutted against the limiting parts, at positions corresponding to the limiting parts.

In addition, the preferred scheme is that, the yoke comprises a bottom wall fixedly combined with the central magnet and the edge magnets, and stoppers protruding from edge of the bottom wall; wherein, the stoppers are provided to correspond to the limiting parts at the corners of the edge magnets, and the lateral surfaces of the stoppers closer to the magnetic gap are located at the same plane with the lateral surfaces of the edge magnets closer to the magnetic gap, respectively.

In addition, the preferred scheme is that, the number of the edge magnets is two, wherein the two edge magnets are combined with the yoke and located at opposite sides of the central magnet respectively; and the yoke comprises two long-axis sides opposite to each other and two short-axis sides opposite to each other, wherein the edge magnets are provided at the two long-axis sides and the stoppers are provided at the two short-axis sides of the yoke.

In addition, the preferred scheme is that, the upper surfaces of the stoppers and the upper surfaces of the edge magnets are located at the same plane.

In addition, the preferred scheme is that, the central magnet is combined with a central pole plate on a surface of the central magnet away from the yoke, the edge magnets are combined with edge pole plates on surfaces of the edge magnets away from the yoke; wherein the edge pole plates are provided with pole plate limiting parts, which are formed by removing materials, at positions facing the limiting parts of the edge magnets, and the stoppers are abutted against both the limiting parts of the edge magnets and the pole plate limiting parts of the edge pole plates.

In addition, the preferred scheme is that, the upper surfaces of the stoppers are flush with the upper surfaces of the edge pole plates.

In addition, the preferred scheme is that, each of the limiting parts has a bent surface defining a right angle, and each of the stoppers has a rectangular column shape.

In addition, the preferred scheme is that, each of the limiting parts has a curved surface, and each of the stoppers also has a curved surface at a position corresponding to one of the limiting parts.

In addition, the preferred scheme is that, the number of the edge magnets is four, wherein the four edge magnets are provided around the central magnet; and the yoke comprises two groups of opposite sides, each side of the yoke is combined with one of the edge magnets, and each of corners of the yoke is provided with two said stoppers, and the stoppers are provided to correspond to the corners of the edge magnets.

Compared with conventional structures, by adopting the above technical scheme, each of the edge magnets of the present invention is provided with limiting parts formed by removing materials, and the yoke is provided thereon with stoppers for preventing the edge magnets from moving to the central magnet, so that a bad phenomenon due to the fact that the edge magnets and the central magnet are attracted to each other can be avoided, thereby increasing the yield of products.

BRIEF DESCRIPTION OF THE DRAWINGS

The above features and technical advantages of the present invention will become more clear and easy to understand through the descriptions of the present invention in connection with the accompanying drawings below.

DETAILED DESCRIPTIONS

Hereinafter, the present invention will be described in details in connection with the accompanying drawings and particular embodiments.

Embodiment 1

Figure 1:
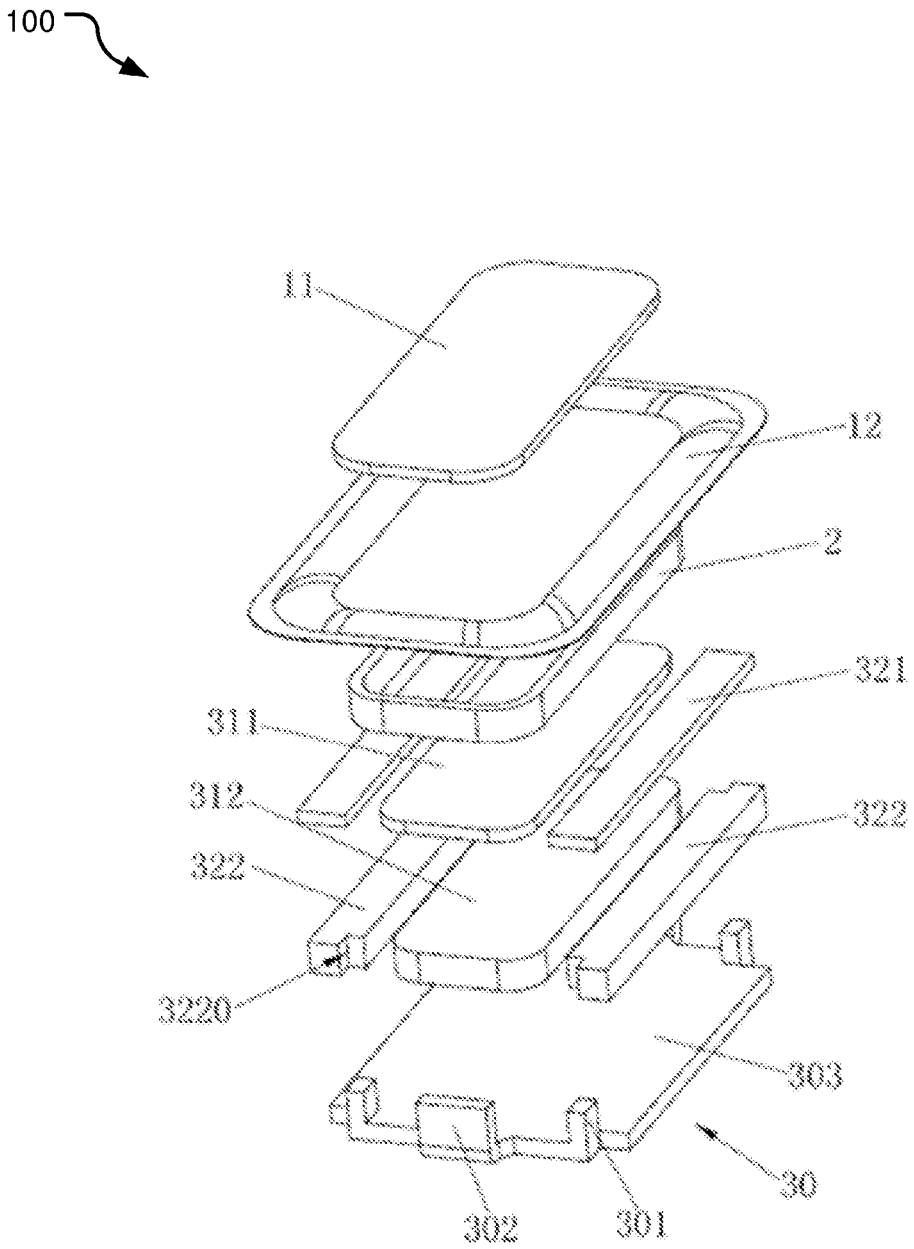
FIG. 1 is a three-dimensional structure exploded view of the electroacoustic transducer according to the first embodiment of the present invention.
Figure 2:
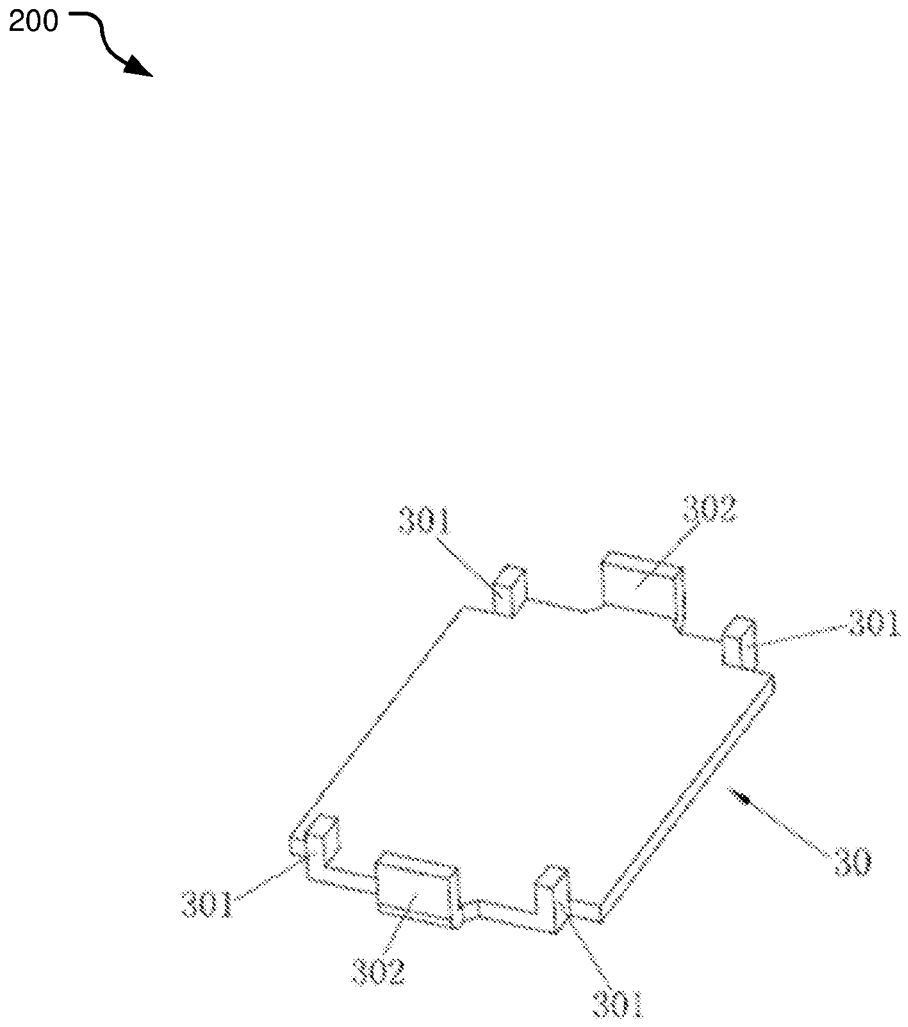
FIG. 2 is a three-dimensional structure view of the of the yoke according to the first embodiment of the present invention.
Figure 3:
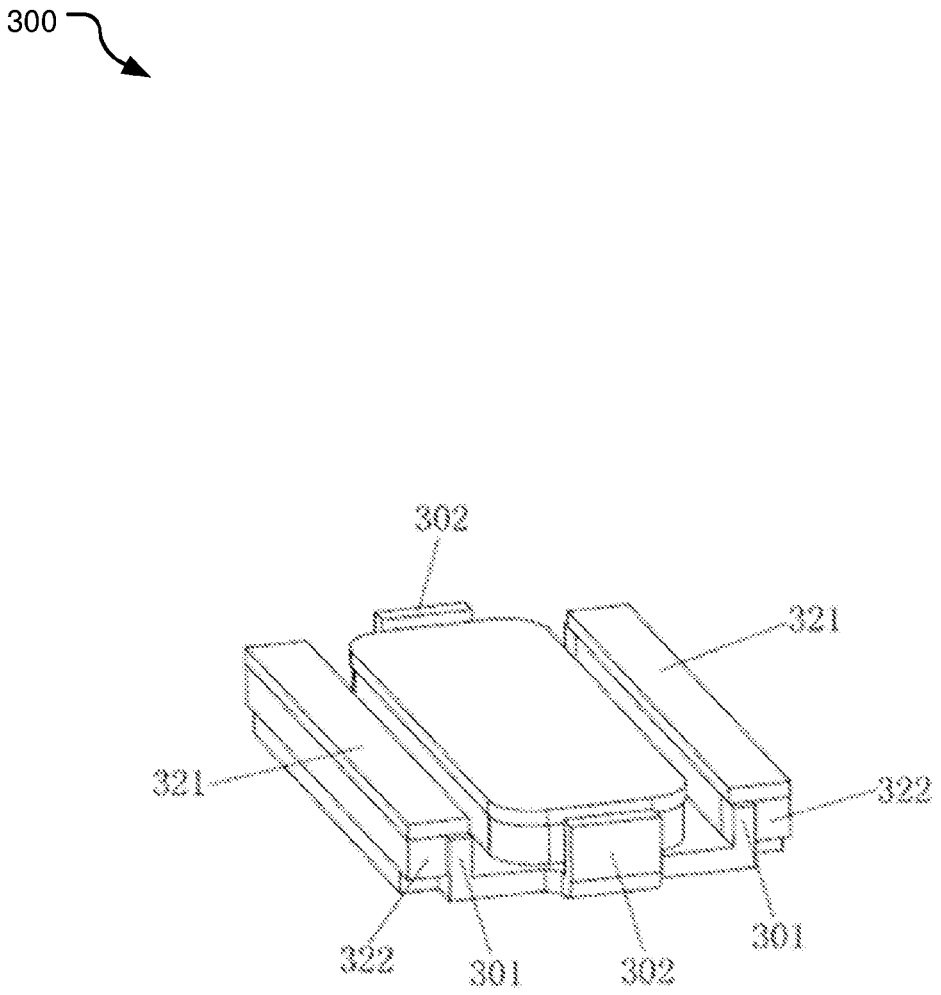
FIG. 3 is a three-dimensional structure view of the assembled magnetic circuit system according to the first embodiment of the present invention.

As shown in FIG. 1 to FIG. 3, the electroacoustic transducer comprises a vibration system and a magnetic circuit system, the vibration system and the magnetic circuit system may be provided either in a speaker module or in a speaker unit, and the electroacoustic transducer further comprises a housing of the module or the unit to accommodate and fix the vibration system and the magnetic circuit system (the housing is not shown in the accompanying drawings, and can be achieved by those skilled in the art with common knowledge in the art). Wherein the vibration system comprises a vibrating diaphragm and a voice coil 2 combined with the vibrating diaphragm on the lower surface thereof, and the vibrating diaphragm comprises a relatively flexible vibrating diaphragm body 12, and a rigid dome portion 11 coupled to central position of the vibrating diaphragm body 12. The magnetic circuit system comprises pole plates, magnets and a yoke 30 which are successively combined. The magnetic circuit system in the present embodiment has a dual magnetic circuit structure, which comprises a central magnet 312 bonded to central position of the yoke 30, and two edge magnets 322 bonded to edge positions of the yoke 30 and located at opposite sides of the central magnet 312. The magnetic circuit system is formed with a magnetic gap to accommodate the voice coil 2, specifically, the magnetic gap in the present embodiment is a gap formed between the central magnet 312 and the edge magnets 322. After electric signal is supplied, the voice coil 2 is subjected to force in the magnetic field in the magnetic gap and vibrates up and down, and further vibrates a vibrating diaphragm to generate sound. The central magnet 312 is combined with a central pole plate 311 on a surface of the central magnet 312 away from the yoke 30, the edge magnets 322 are combined with edge pole plates 321 on surfaces of the edge magnets 322 away from the yoke 30, wherein the central pole plate 311 and the edge pole plates 321 are made from a permeability magnetic material, so as to correct magnetic lines of force.

Preferably, the yoke 30 comprises a flat plate-shaped bottom wall 303 and sidewalls 302 extending at a certain angle with respect to the bottom wall 303, wherein the bottom wall 303 of the yoke 30 has a approximately rectangular shape, a rectangular central magnet 312 is provided at central position of the rectangular bottom wall 303; and each of the edge magnets 322 has a strip shape, and the edge magnets 322 are bonded to edge positions of the two long-axis sides of the rectangular yoke 30 and are provided to correspond to two long-axis sides of the rectangular central magnet 312. The sidewalls 302 are provided at the two short-axis sides of the yoke 30 to which the edge magnets 322 are not bonded, and the sidewalls 302 enable the central magnet 312 to realize connection of the magnetic circuits through magnetic conduction of the sidewalls 302, so as to adequately utilize the magnetic lines of force generated by the magnets, thereby improving the magnetic property of the magnetic circuit system. It is preferred that the sidewalls 302 are provided to be perpendicular to the bottom wall, so as to adjust the direction of magnetic lines of force better.

In addition, limiting parts 3220 formed by removing materials are provided at the corners of the two edge magnets 322 closer to the magnetic gap (or the voice coil 2), the limiting parts 3220 are structures formed by removing materials at the corners of the edge magnets 322, and the limiting parts 3220 of the present embodiment are located at two corners of each of the edge magnets 322 closer to the magnetic gap. A group of opposite sides of the yoke 30 provided with sidewalls 302 are further provided with stoppers 301 integrally extending from the bottom wall 303, and the stoppers 301 are perpendicular to the bottom wall 303 and are provided to correspond to the limiting parts 3220. Each of the stoppers 301 of the present embodiment has a rectangular column shape, and each of the parts, which are removed to form the limiting parts 3220, also has a rectangular column shape. The stoppers 301 are located at one side of the limiting parts 3220 closer to the magnetic gap, and are abutted against the limiting parts 3220, thereby preventing the edge magnets 322 from moving to the central magnet 312 due to attraction from the central magnet 312, so that defects occurred in the products due to the fact that the central magnet 312 and the edge magnets 322 are attracted to each other can be avoided.

Preferably, the lateral surfaces of the stoppers 301 closer to the magnetic gap are located at the same plane with the lateral surfaces of the edge magnets 322 closer to the magnetic gap, respectively, which can avoid collision between the voice coil 2 and the stoppers 301; in addition, compared with a structure with the lateral surfaces of the stoppers 301 closer to the magnetic gap being recessed, the structure with lateral surfaces located at the same plane can ensure the strength of the stoppers 301, thereby increasing the stability of the products.

Embodiment 2

Figure 4:
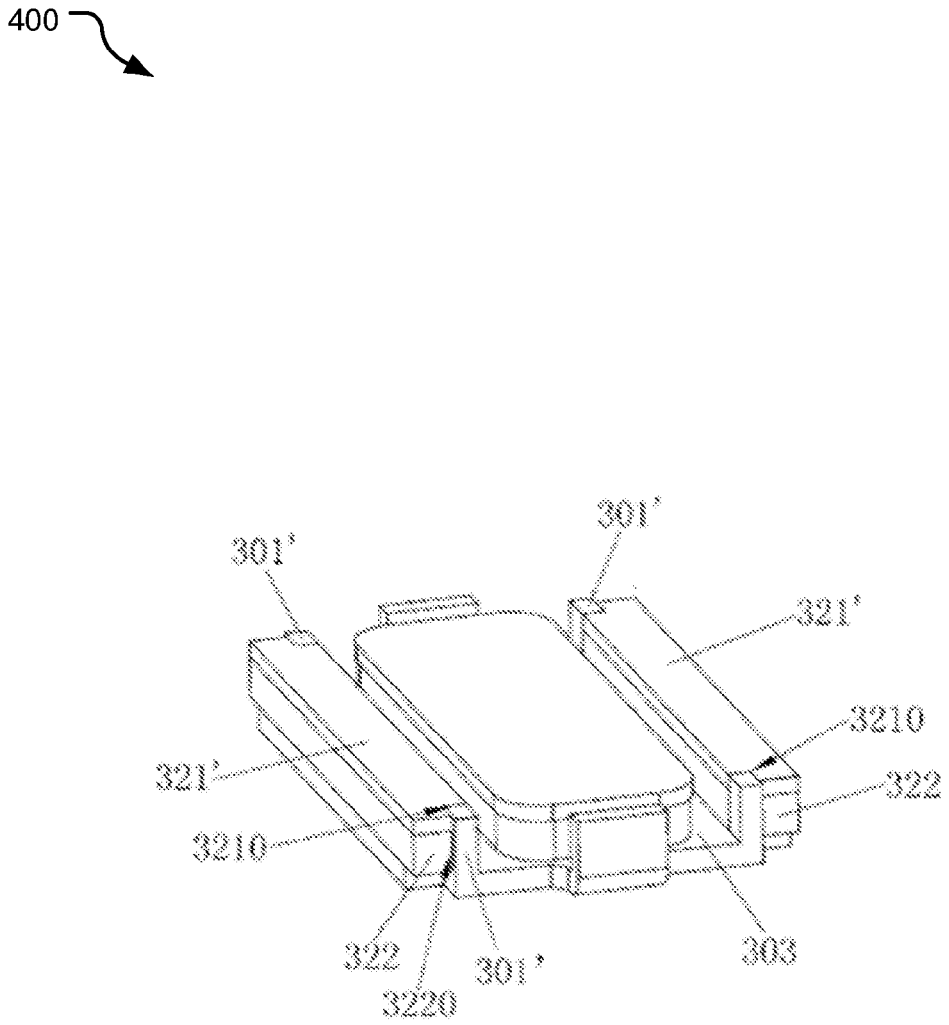
FIG. 4 is a three-dimensional structure view of the assembled magnetic circuit system according to the second embodiment of the present invention.

As shown in FIG. 4, the main difference between the present embodiment and embodiment 1 is that the edge pole plates 321' are provided with the pole plate limiting parts 3210, which are formed by removing materials, at positions corresponding to the limiting parts 3220 of the edge magnets 322, wherein the shape of the pole plate limiting parts 3210 are the same as that of the limiting parts 3220 of the edge magnets 322. Each of the stoppers 301' has a rectangular column shape, and the upper surfaces of the stoppers 301' are flush with the upper surfaces of the edge pole plates 321', as shown in FIG. 4. The structure with the stoppers 301' being further extended while abutted against the edge pole plates 321' can effectively prevent the edge pole plates 321' and the edge magnets 322 from moving toward the central magnet 312, thereby further ensuring the stability of the magnetic circuit system with such a dual magnetic circuit structure.

Embodiment 3

Figure 5:
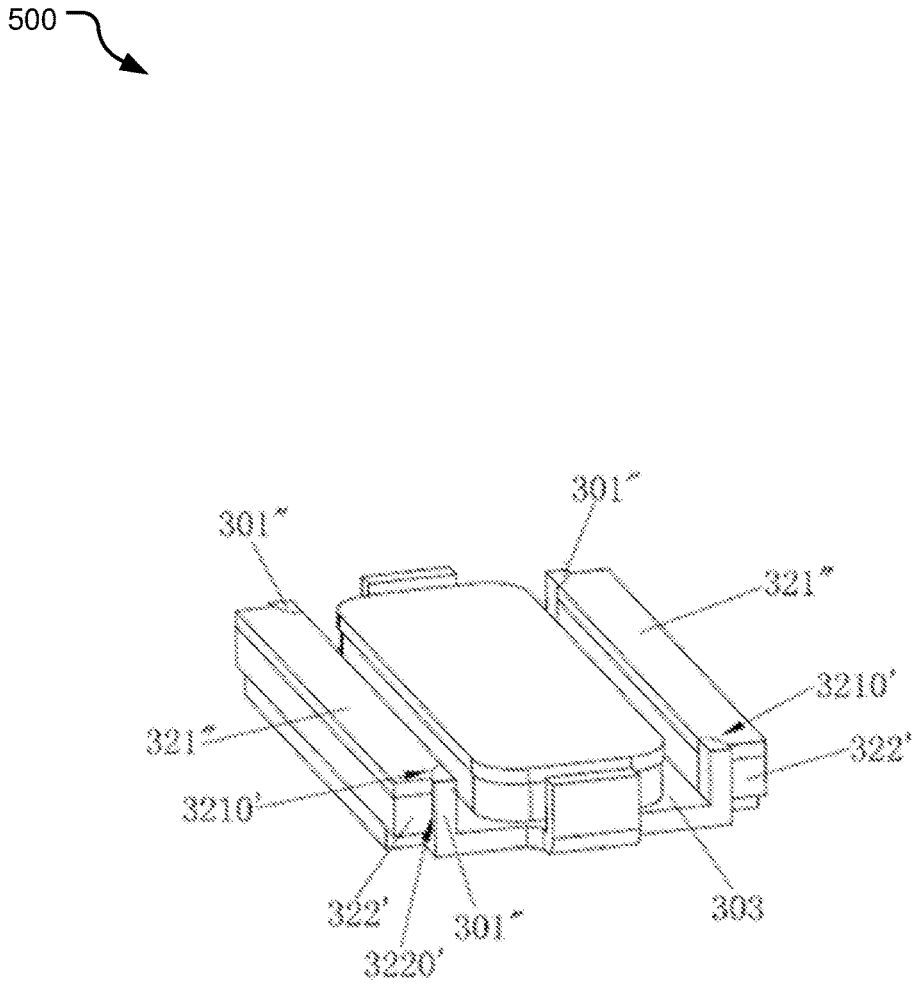
FIG. 5 is a three-dimensional structure view of the assembled magnetic circuit system according to the third embodiment of the present invention.

As shown in FIG. 5, the main difference between the present embodiment and above embodiments is that, each of the limiting parts 3220' of the edge magnets 322' and the pole plate limiting parts 3210' has a curved surface, and each of the stoppers 301" also has a curved surface at the positions where the stoppers 301" are combined with the limiting parts and the pole plate limiting parts. Such a structure also can prevent the edge pole plates 321' and the edge magnets 322' from moving toward the central magnet due to attraction from the central magnet, thereby ensuring the stability of the magnetic circuit system.

In addition, the shape of the stoppers is not limited to such a shape, and each of the stoppers may have a cylindrical shape or other shape, which all fall into the scope of the present invention, as long as it can correspond to the limiting parts. Alternatively, in the present embodiment, limiting parts can be only provided on the edge magnets, but not on the edge pole plates, and the stoppers are only used for limiting the edge magnets.

It should be noted that, in the present invention, the number of the edge magnets may be four, the central magnet has a rectangular shape, and four edge magnets are provided around the central magnet. The yoke has a rectangular shape, and the edge of each side of the yoke is combined with one edge magnet. Limiting parts are provided on each of the edge magnets at two corners thereof closer to the magnetic gap, the limiting parts are located at the corners of the yoke, each corner of the yoke is provided with two stoppers, and each of the stoppers corresponds to one limiting part, thereby limiting the positions of the edge magnets through the stoppers of the yoke, and preventing the edge magnets from moving toward the central magnet.

With the above teaching of the present invention, other improvements and variants can be made by those skilled in the art based on the above embodiments, and the improvements and variants are within the scope of the present invention. It will be understood by those skilled in the art that the above specific description aims at better understanding of the present invention, and the scope of the present invention is limited by the claims and its equivalents.

What is claimed is:

1. An electroacoustic transducer, comprising a vibration system and a magnetic circuit system, wherein the vibration system comprises a vibrating diaphragm and a voice coil combined with the vibrating diaphragm on a lower surface thereof; and the magnetic circuit system comprises a yoke, a central magnet located at central position of the yoke and at a side of the yoke closer to the voice coil, and two edge magnets combined with the yoke and located at edge positions of the yoke and at opposite sides of the central magnet, wherein the magnetic circuit system is formed with a magnetic gap to accommodate the voice coil, wherein:

each of the two edge magnets has a strip shape, limiting parts are provided on each of the two edge magnets at two corners thereof closer to the magnetic gap, the limiting parts are formed by removed materials at the corners of the two edge magnets, and the yoke is provided with stoppers, which are abutted against the limiting parts, at positions corresponding to the limiting parts, to prevent the central magnet and the two edge magnets from being attracted together;

the yoke comprises a bottom wall fixedly combined with the central magnet and the two edge magnets, the yoke further comprises two long-axis sides opposite to each other and two short-axis sides opposite to each other, with the two edge magnets provided at the two long-axis sides and the stoppers are provided at the two short-axis sides of the yoke, with the stoppers protruding from an edge of the bottom wall;

wherein, the stoppers are provided to correspond to the limiting parts at the corners of the two edge magnets, and lateral surfaces of the stoppers closer to the magnetic gap are located at a same plane with lateral surfaces of the edge magnets closer to the magnetic gap, respectively;

the central magnet is combined with a central pole plate on a surface of the central magnet away from the yoke, the two edge magnets are combined with edge pole plates on surfaces of the edge magnets away from the yoke, the edge pole plates are provided with pole plate limiting parts, which are formed by removing materials, at positions facing the limiting parts of the two edge magnets, and the stoppers are abutted against both the limiting parts of the edge magnets and the pole plate limiting parts; and upper surfaces of the stoppers are flush with upper surfaces of the edge pole plates.

2. The electroacoustic transducer according to claim 1, wherein, each of the limiting parts has a bent surface defining a right angle, and each of the stoppers has a rectangular column shape.

3. The electroacoustic transducer according to claim 1, wherein, each of the limiting parts has a curved surface, and each of the stoppers also has a curved surface at a position corresponding to one of the limiting parts.

4. The electroacoustic transducer according to claim 1, wherein, a number of the edge magnets is four, and the four edge magnets are provided around the central magnet;

the yoke comprises two groups of opposite sides, each side of the yoke is combined with one of the edge magnets, and each of the corners of the yoke is provided with two said stoppers, and the stoppers are provided to correspond to the corners of the edge magnets.

* * * * *